US007011078B2

(12) United States Patent
Yamaguchi et al.

(10) Patent No.: US 7,011,078 B2
(45) Date of Patent: Mar. 14, 2006

(54) TWO-STROKE INTERNAL COMBUSTION ENGINE

(75) Inventors: Shiro Yamaguchi, Tokyo (JP); Kentaro Matsuo, Saitama (JP); Keita Kamo, Tokyo (JP); Hidekazu Tsunoda, Tokyo (JP)

(73) Assignee: Kioritz Corporation, Tokyo (JP)

( * ) Notice: Subject to any disclaimer, the term of this patent is extended or adjusted under 35 U.S.C. 154(b) by 0 days.

(21) Appl. No.: 10/899,770

(22) Filed: Jul. 27, 2004

(65) Prior Publication Data

US 2005/0022757 A1 Feb. 3, 2005

(30) Foreign Application Priority Data

Aug. 1, 2003 (JP) ..... 2003/285302

(51) Int. Cl.
*F02B 43/00* (2006.01)

(52) U.S. Cl. ..... 123/527
(58) Field of Classification Search ..... 123/527
See application file for complete search history.

(56) References Cited

U.S. PATENT DOCUMENTS 6,279,521 B1 8/2001 Ishida et al.

OTHER PUBLICATIONS

Patent Abstract of Japan, Publication No. 57-140519 dated Aug. 31, 1982, Application No. 56-025782, dated Feb. 23, 1981, for Two-Cycle Engine, Applicant: Kawasaki Heavy Ind. Ltd., of Fujimoto Kan et al.

*Primary Examiner*—Mahmoud Gimie
*Assistant Examiner*—Katrina B. Harris
(74) *Attorney, Agent, or Firm*—Baker Botts L.L.P.

(57) ABSTRACT

A two-stroke internal combustion engine (1) is provided with one pair or plural pairs of C-shaped scavenging passageways (31, 32) of a reverse flow system where scavenging inlet ports (31*a*) as well as scavenging outlet ports (31*b*, 32*b*) are both opened to a cylinder bore (10*a*), wherein a scavenging introducing passageway (40) for introducing an air-fuel mixture (K) from a crank chamber (18) into the scavenging inlet ports (31*a*) is provided between the cylinder bore and the piston adapted to reciprocatively move up and down in the cylinder bore (10*a*), and an effective opening area of the scavenging inlet ports (31*a*) is gradually decreased due to the piston (20) in the course of descending stroke of the piston (20).

3 Claims, 9 Drawing Sheets

(A)

(B)

(A)

(B)

TWO-STROKE INTERNAL COMBUSTION ENGINE

BACKGROUND OF THE INVENTION

The present invention relates to a two-stroke internal combustion engine which is suited for use for example in a portable power working machine, and in particular, to a two-stroke internal combustion engine which is capable of rendering combustion waste gas (exhaust gas) per se to be more completely cleaned and also capable of minimizing as much as possible the quantity of so-called blow-by or the quantity of air-fuel mixture to be discharged without being utilized for the combustion.

An ordinary two-stroke gasoline engine which is conventionally used in a portable power working machine such as a chain saw or brush cutter is constructed such that an ignition plug is disposed at the head portion of the cylinder, and that an intake port, a scavenging port and an exhaust port, which are to be opened and closed by a piston, are provided so as to communicate with the cylinder bore (or provided in the inner peripheral wall of the cylinder). According to this two-stroke internal combustion engine, one cycle of the engine is accomplished by two strokes of the piston without undergoing a stroke which is exclusively assigned to the intake or the exhaust.

More specifically, in the ascending stroke of the piston, an air-fuel mixture consisting of a mixture comprising of air, fuel and lubricant is introduced from the intake port into the crank chamber disposed below the piston. Then, in the descending stroke of the piston, the air-fuel mixture is pre-compressed in the crank chamber producing a compressed gas mixture, which is then blown into a combustion actuating chamber which is disposed above the piston, thereby enabling waste combustion gas to be discharged from the exhaust port. In other words, the scavenging of the waste combustion gas is effected by making use of the gas flow of the air-fuel mixture.

Therefore, the unburnt air-fuel mixture is more likely to be mingled into the combustion gas (exhaust gas), thus increasing the quantity of so-called blow-by or the quantity of air-fuel mixture to be discharged into air atmosphere without being utilized for combustion. Because of this, as compared with a four-stroke engine, the two-stroke internal combustion engine is not only inferior in fuel consumption but also disadvantageous in that a large amount of poisonous components such as HC (unburnt components in a fuel) and CO (incomplete combustion components in a fuel) are caused to be included into the exhaust gas. Therefore, even if the two-stroke engine is small in capacity, the influence of these poisonous components on the environmental contamination cannot be disregarded. Additionally, there are several problems as to how to cope with the regulation of exhaust gas which is expected to become increasingly severe in the future. In particular, there are many difficulties as to how to cope with the minimization of HC (total HC) in exhaust gas.

Further, since the two-stroke internal combustion engine is designed to employ a blended fuel consisting of gasoline as fuel and lubricating oil, there are possibilities that the exhaust gas would be further contaminated due to this oil component, and that this oil component would be allowed to excessively flow into the combustion actuating chamber (though it may also be called combustion chamber, actuating chamber, cylinder chamber, etc., these chambers are generically referred to as a combustion actuating chamber in the present specification), thereby sometimes inviting operating malfunctions such as engine stalls.

With a view to overcome these problems, there have been proposed various kinds of countermeasures. For example, JP Patent Publication No. 60-48609 (1985) discloses a two-stroke internal combustion engine which is provided with a scavenging passageway of a reverse scavenging system (Schnürle type scavenging system) where the combustion actuating chamber to be formed over the piston is communicated with the crank chamber. This two-stroke internal combustion engine has the cross-sectional area of the scavenging outlet port (situated on the combustion actuating chamber side) of the scavenging passageway made smaller (reducing the cross-sectional area to 60% or less) than the cross-sectional area of the scavenging inlet port (situated on the crank chamber side) to thereby enhance the flow rate of scavenging to be blown into the combustion actuating chamber, thus enhancing the scavenging efficiency and minimizing the quantity of blow-by.

Further, JP Laid-open Patent Publication (Kokai) No. 2000-179346 discloses that if the cross-sectional area of the inlet port of the scavenging passageway is approximately the same as that of the outlet port of the scavenging passageway, the air-fuel mixture (scavenging gas) that has been pushed out of the crank chamber is permitted to rapidly flow into the combustion actuating chamber from the scavenging outlet port, thus permitting a large quantity of the air-fuel mixture to be discharged together with exhaust gas to the external atmosphere. In order to prevent such a phenomenon, the publication proposes considerably contracting the cross-sectional area of the inlet port of the scavenging passageway (or scavenging introducing passageway) as compared with the cross-sectional area of the scavenging passageway. By contracting the scavenging inlet port (or scavenging introducing passageway) in this manner, it is possible to prevent the scavenging gas from rapidly flow into the combustion actuating chamber from the scavenging outlet port, so that the scavenging gas can be gradually fed to the combustion actuating chamber until the scavenging stroke is placed into the latter half stage thereof. As a result, the quantity of blow-by can be greatly minimized.

In the case of the two-stroke internal combustion engine described in JP Patent Publication No. 60-48609, however, the compression ratio (pressure) of the air-fuel mixture inside the crank chamber is caused to become lower in the latter half stage (in the vicinity of bottom dead center) of the descending stroke (scavenging stroke) as compared with the compression ratio of the air-fuel mixture up to the intermediate stage of the descending stroke so that the flow rate of the scavenging gas to be blown into the combustion actuating chamber from the scavenging outlet is also caused to decrease. Therefore, it is impossible to obtain a sufficient degree of scavenging effect as desired. Rather, scavenging gas (air-fuel mixture) is more likely to be intermingled with the exhaust gas and hence it is impossible to sufficiently minimize the quantity of blow-by.

Further, in the case of the two-stroke internal combustion engine described in JP Laid-open Patent Publication (Kokai) No. 2000-179346, since the scavenging gas is prevented from rapidly flowing into the combustion actuating chamber from the scavenging outlet port due to the effect of the contracted scavenging outlet port (scavenging introducing passageway), the flow rate of the scavenging gas flow in particular in the first half stage of the descending stroke (scavenging stroke) of the piston is caused to become lower than that of the scavenging flow which is described in JP Patent Publication No. 60-48609, so that it is impossible to expect the minimization in quantity of blow-by in such a sufficient degree as desired.

The present invention has been made in view of overcoming the aforementioned problems, and therefore an object of the present invention is to provide a two-stroke internal combustion engine which can be manufactured without necessitating the tremendous modification of the structure thereof, which can be manufactured at low cost, and which is capable of effectively suppressing the blow-by of unburnt air-fuel mixture, of minimizing as much as possible poisonous components such as HC, etc. that may be discharged into air atmosphere, and of preventing the malfunctions that may be brought about due to excessive supply of the lubricating oil into the combustion actuating chamber.

BRIEF SUMMARY OF THE INVENTION

With a view to realize the aforementioned object, the two-stroke internal combustion engine according to the present invention is basically constructed such that the engine is provided with one pair or plural pairs of C-shaped scavenging passageways of a reverse flow system where the scavenging inlet port(s) as well as the scavenging outlet port(s) are both opened to the cylinder bore.

The engine is also provided, between the cylinder bore and the piston adapted to reciprocatively move up and down in the cylinder bore, with a scavenging introducing passageway for introducing an air-fuel mixture from the crank chamber into the scavenging inlet port(s), the effective opening area of which is designed to be gradually decreased by the piston in the course of descending stroke of the piston.

In a preferred embodiment, a cut-out portion for constituting the scavenging introducing passageway is formed on a lower external peripheral wall of the piston, and the effective opening area of the scavenging inlet port(s) is designed to be gradually decreased in the course of descending stroke of the piston due to an upper external peripheral wall of the piston having the aforementioned cut-out portion.

In another preferred embodiment, the cylinder bore is provided with a longitudinal groove constituting part of the scavenging introducing passageway.

In the two-stroke internal combustion engine of the present invention, the total cross-sectional area of the scavenging introducing passageway should preferably be not more than 40% and more preferably about ⅓ of the total cross-sectional area of the scavenging passageways.

According to the two-stroke internal combustion engine of the present invention, which is constructed as described above, as the pressure of the crank chamber is decreased in the ascending stroke of the piston, air-fuel mixture (an atomized mixture consisting of gasoline as a fuel, air and lubricating oil) to be fed from the air-fuel mixture-generating means such as a carburetor is sucked up and stored in the crank chamber.

When the air-fuel mixture inside this combustion actuating chamber disposed above the piston is exploded and burnt through the ignition thereof, the piston is pushed downward due to the generation of combustion gas. In this descending stroke of the piston, the air as well as the air-fuel mixture existing inside the crank chamber and the scavenging passageways are compressed by the piston, and at the same time, the exhaust port is opened at first, and as the piston is further descended, the scavenging port provided at a downstream end of each of the scavenging passageways is opened. During this scavenging period where the scavenging outlet port is kept opened, the effective opening area of this scavenging outlet port is caused to gradually increase due to the descending movement of the piston and at the same time, the effective opening area of this scavenging inlet port is caused to gradually decrease. Then, the air-fuel mixture that has been compressed in the crank chamber is permitted to be introduced, via the scavenging introducing passageways provided between the cylinder bore and the piston, into the scavenging inlet port and then ejected from this scavenging inlet port toward the downstream side of the scavenging passageway and sucked in the direction of the combustion actuating chamber. Thereafter, the air-fuel mixture is blown out, as a scavenging flow, from the scavenging outlet port at a predetermined horizontal scavenging angle toward the inner wall of the cylinder bore which is located opposite to the exhaust port. Upon being impinged against this inner wall of the cylinder bore, the flow of air-fuel mixture is caused to turn around, thus pushing the combustion waste gas (exhaust gas) toward the exhaust port.

In this case, since the cross-sectional area of the scavenging introducing passageway is made smaller than the cross-sectional area of the scavenging passageway (preferably, about ⅓) and at the same time, the scavenging inlet port is designed to be gradually narrowed (or contracted) concomitant with the descending movement of the piston, the degree of reduction in pressure and flow rate of the scavenging gas can be minimized even in the latter stage of the descending stroke of the piston (in the vicinity of bottom dead center) as compared with the conventional engine where the scavenging inlet port which opens to the crank chamber is not contracted (i.e. the cross-sectional area of the scavenging inlet port is substantially the same as the cross-sectional area of the scavenging passageway). Because of this, it is possible to provide the scavenging gas to be blown out from the scavenging outlet port into the combustion actuating chamber with a predetermined thrusting force (pressure) and with a directionality until the scavenging stroke is completed (until the piston reaches the bottom dead center). Therefore, it is now possible to further promote the atomization effect of fuel during the scavenging stroke, to improve the scavenging efficiency (trapping efficiency) and to enhance the combustion efficiency. As a result, it is now possible to effectively minimize the poisonous components, in particular, the total HC, and additionally to enhance fuel consumption.

Further, since the scavenging introducing passageway is provided by simply forming a cut-out portion in the form of parallel chamfering at the lower external peripheral wall (skirt portion) of the piston, it is no longer required to separately prepare parts or to greatly modify the conventional engine, thus rendering the present invention highly advantageous in terms of manufacturing cost.

Additionally, in the case of a two-stroke internal combustion engine, fuel (gasoline) is usually mixed with lubricating oil before use, so that the fuel/lubricating oil mixture in the air/fuel mixture that has been introduced into the crank chamber is subjected to the effect of centrifugal separation especially on the occasion of the high-speed revolution of the engine, resulting in the separation of much of the fuel/lubricating oil mixture from the air component, thus allowing the fuel/lubricating oil mixture to adhere onto the inner wall of the crank chamber. In this case, since the cross-sectional area of the scavenging inlet port (the aforementioned scavenging introducing passageway) is made relatively narrow, the lubricating oil is permitted to easily separate from the fuel component prior to the introduction of the air/fuel mixture into the scavenging passageway, thus permitting much of the lubricating oil to leave in the crank chamber. Therefore, even if the supply flow rate of fuel (the fuel/lubricating oil mixture) is reduced (i.e. even if the air/fuel mixture is made more lean), it is possible to secure a sufficient quantity of lubricating oil required for lubricating the sliding components such as the piston, connecting rod, crank shaft, etc., thus preventing the lubricity of these components from being deteriorated.

Further, when the engine (of a portable working machine) is suddenly changed in attitude to a great extent (for example, when the body of chain saw is suddenly inclined upward) in the idling operation thereof, the fuel/lubricating oil mixture which remains as fluid in the crank chamber is permitted to excessively flow into the combustion actuating chamber through the scavenging passageway if the scavenging inlet port is disposed on the crank chamber side, thereby possibly resulting in the malfunction of engine such as by engine stall. In the case of the present invention, however, the fuel/lubricating oil mixture which is left as fluid in the crank chamber is barely permitted to flow at a stroke into the scavenging passageway, thereby making it possible to suppress the engine malfunction.

BRIEF DESCRIPTION OF THE SEVERAL VIEWS OF THE DRAWING

FIG. 4 shows a single body of piston to be employed in the engine shown in FIG. 1, wherein FIG. 4(A) is a side view thereof and FIG. 4(B) is an underside view thereof;

DETAILED DESCRIPTION OF THE INVENTION

Next, various embodiments of the two-stroke internal combustion engine according to the present invention will be explained with reference to the drawings.

Figure 1:
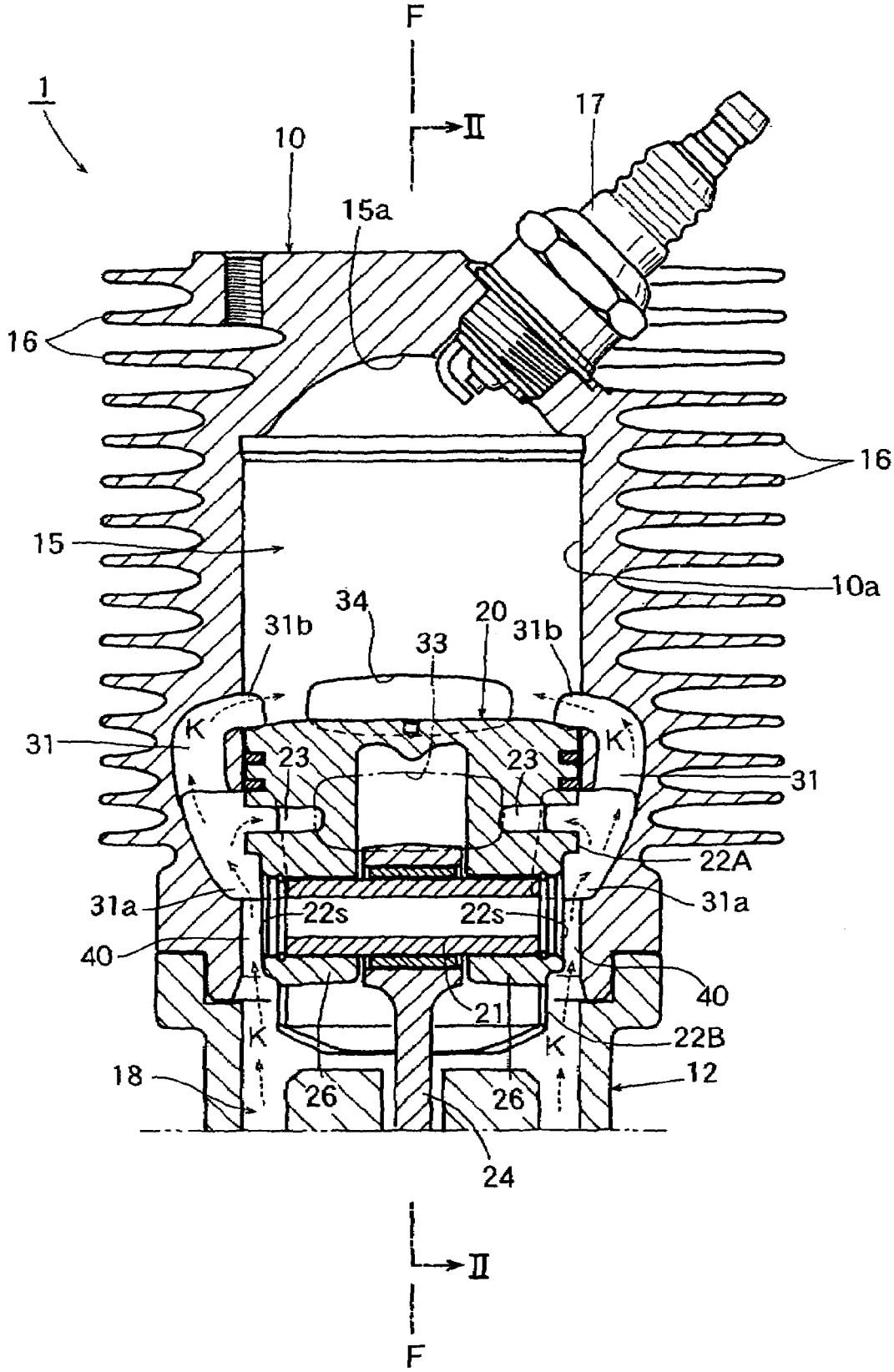
FIG. 1 is a longitudinal sectional view illustrating one embodiment of a two-stroke internal combustion engine according to the present invention.
Figure 2:
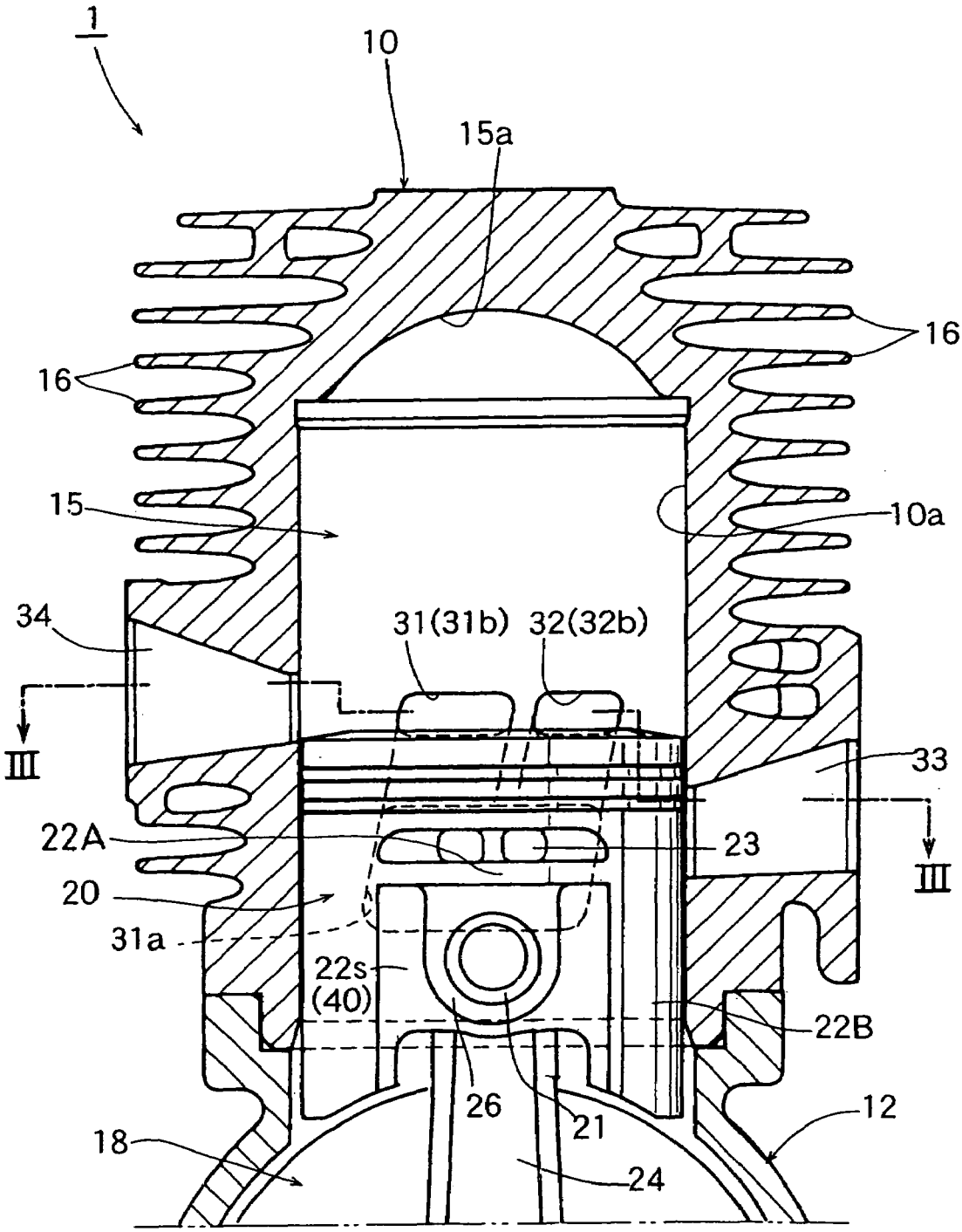
FIG. 2 is a cross-sectional view taken along the line II—II in FIG. 1.
Figure 3:
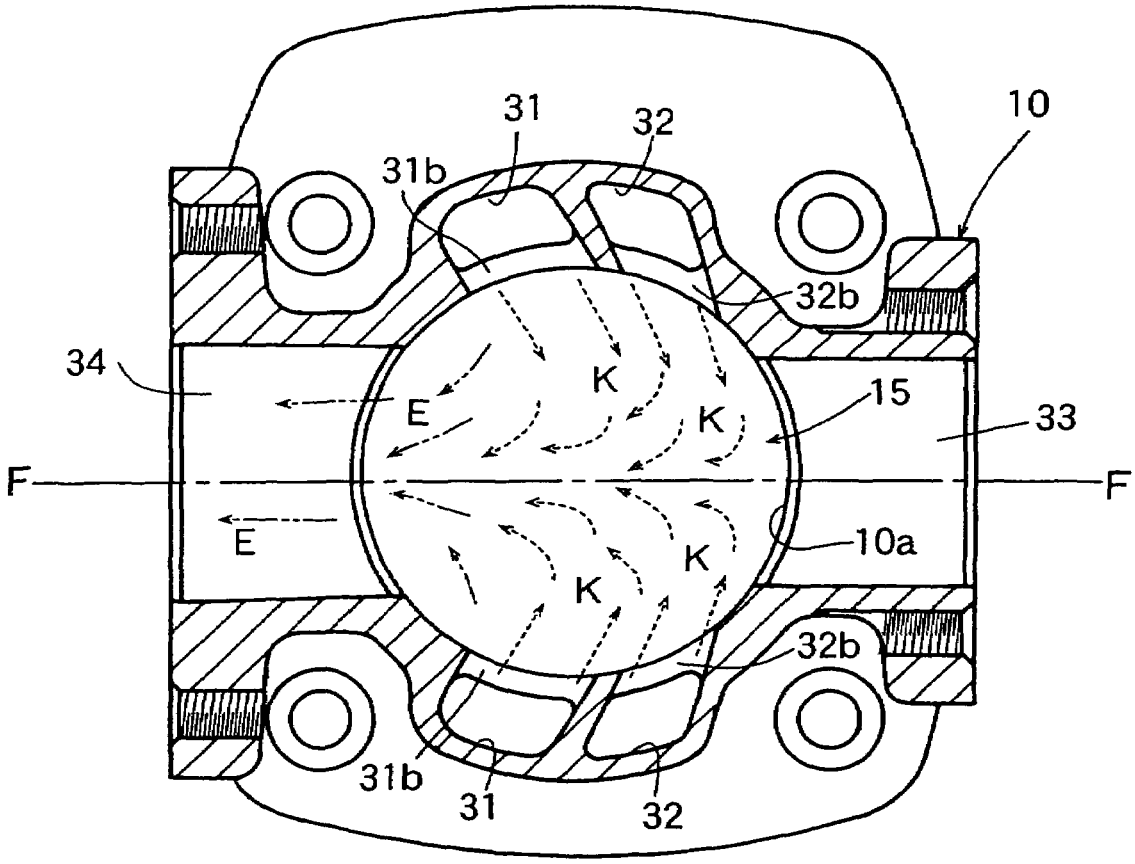
FIG. 3 is a cross-sectional view taken along the line III—III in FIG. 2.

FIG. 1 is a longitudinal sectional view illustrating one embodiment of a two-stroke internal combustion engine according to the present invention; FIG. 2 is a cross-sectional view taken along the line II—II in FIG. 1; and FIG. 3 is a cross-sectional view taken along the line III—III in FIG. 2.

Referring to these FIGS., the two-stroke internal combustion engine 1 shown therein is formed of a small air-cooled two-stroke gasoline engine of the quaternary scavenging type, which is adapted to be employed in a portable working machine. This engine 1 comprises a cylinder 10 in which a piston 20 is fittingly inserted so as to enable it to reciprocatively move up and down, and a crankcase 12 which is disposed below the cylinder 10 and hermetically fastened to the cylinder 10. The crankcase 12 defines a crank chamber 18 below the cylinder 10 and rotatably support a crank shaft (not shown) which is designed to reciprocatively move a piston 20 up and down through a piston pin 21 and a connecting rod 24.

The cylinder 10 is provided, on the outer circumferential wall thereof, with a large number of cooling fins 16, and, at the head portion thereof, with a squish-dome shape (semi-spherical) combustion chamber 15*a* constituting the combustion actuating chamber 15. An ignition plug 17 is protruded into the combustion chamber 15*a*.

An exhaust port 34 is provided so as to open to one side of the cylinder bore 10*a* of the cylinder 10. On the opposite side of the cylinder bore 10*a*, there is provided an intake port 33 which is disposed lower than the exhaust port 34 (i.e. on the crank chamber 18 side). A pair of first scavenging passages 31 (which are located on a side close to the exhaust port 34) as well as another pair of second scavenging passages 32 (which are located on a side opposite to or remote from where the exhaust port 34 is disposed), both respectively constituting a C-shaped scavenging passageway, are symmetrically provided on both sides of the longitudinal section F—F which imaginary line divides, in widthwise, the exhaust port 34 and the intake port 33 into two equal parts, thus constituting a reverse scavenging system (Schnürle type scavenging system) where scavenging inlet ports 31*a* and scavenging outlet ports 31*b* and 32*b* are all opened to the cylinder bore 10*a*. It is to be noted that the scavenging inlet ports 31*a* are designed so as to respectively serve as a common port for both of the first scavenging passages 31 and the second scavenging passages 32.

The scavenging outlet ports 31*b* and 32*b*, which are provided at the upper ends (downstream ends) of the first scavenging passages 31 and the second scavenging passages 32, are respectively deflected horizontally so as to have a predetermined horizontal angle and are all disposed at the same height in longitudinal direction. Further, the location of the top ends of these scavenging outlet ports 31*b* and 32*b* is set lower, by a predetermined distance, than the top end of the exhaust port 34, so that in the descending stroke of the piston 20, these scavenging outlet ports 31*b* and 32*b* are permitted to simultaneously open a moment later than the exhaust port 34.

The scavenging inlet ports 31*a*, which are provided at the lower ends (upstream ends) of the first scavenging passages 31 and the second scavenging passages 32, are respectively designed such that the effective opening area thereof is gradually decreased by the movement of the piston in the descending stroke (scavenging stroke) of the piston 20 as explained hereinafter.

In this embodiment, scavenging introducing passageways 40 are provided between the cylinder bore 10*a* and the piston 20 so as to make it possible to introduce an air-fuel mixture K that has been pre-compressed in the crank chamber 18 into the scavenging inlet ports 31*a*.

Figure 4:
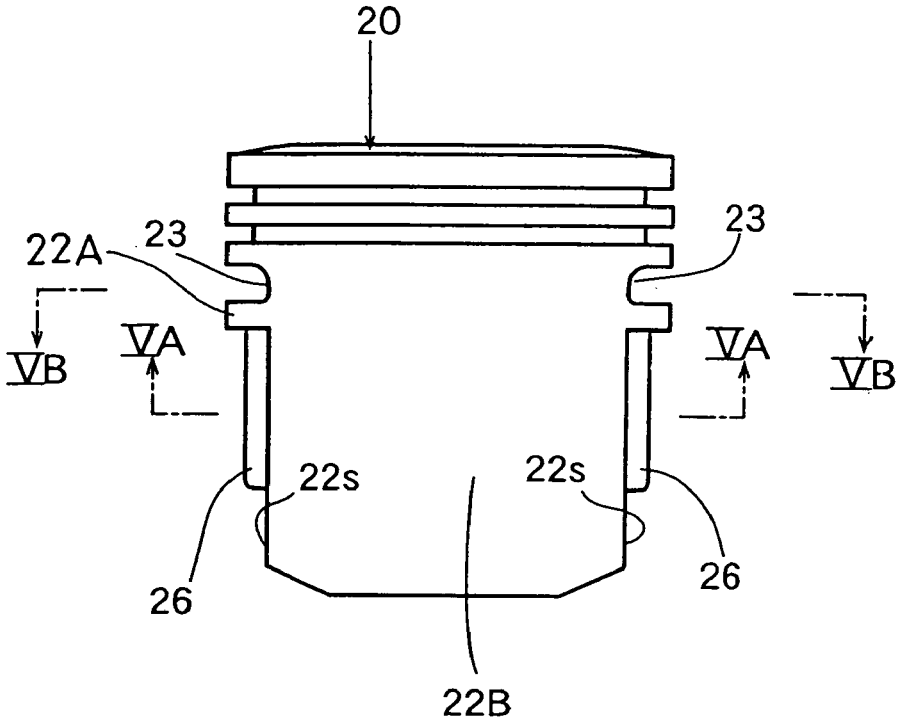
Figure 4:
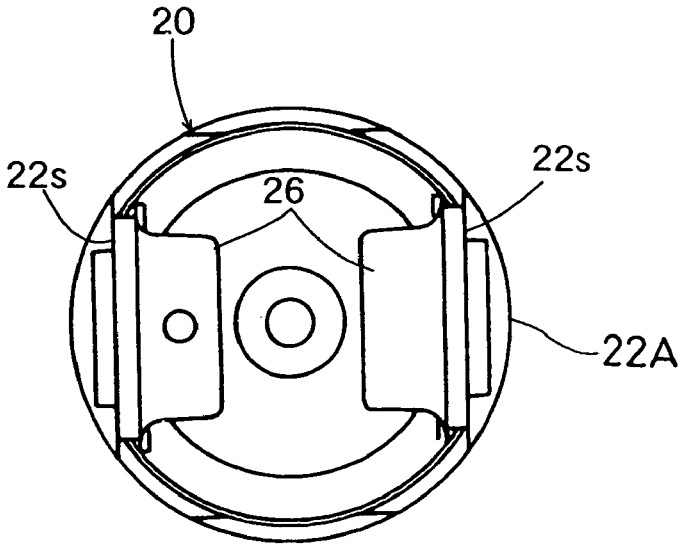
Figure 5:
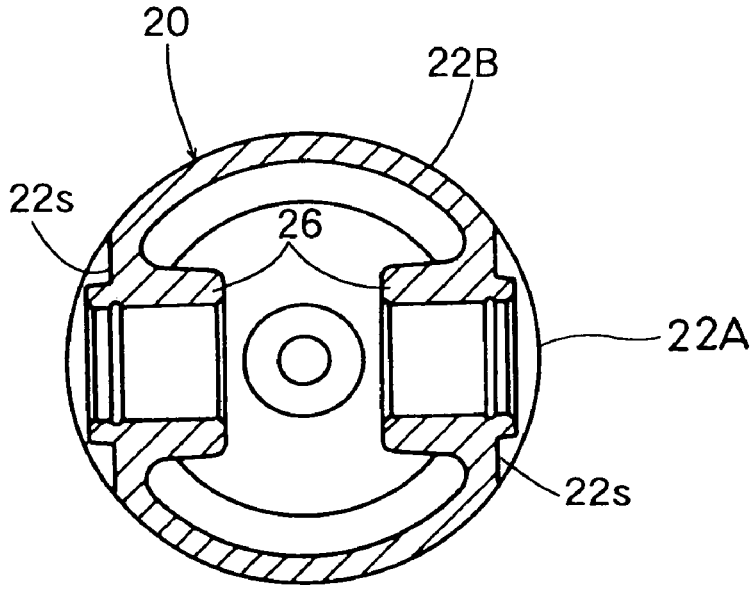
FIG. 5(A) is a cross-sectional view taken along the line VA—VA in FIG. 4(A)
FIG. 5(B) is a cross-sectional view taken along the line VB—VB in FIG. 4(A)
Figure 5:
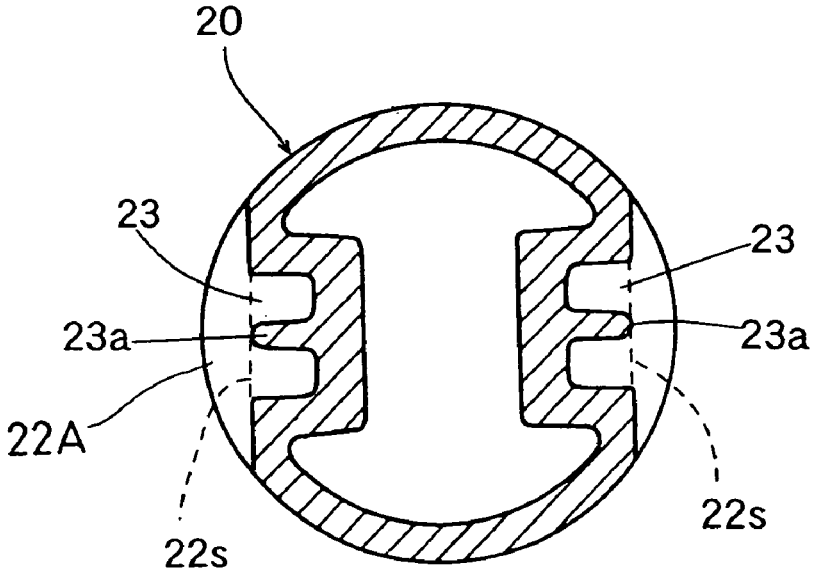

More specifically, as seen from FIGS. 4 and 5 in addition to FIGS. 1 and 2, cut-out portions 22*s* each having a semicylindrical configuration (or parallel-chamfered configuration) and approximately the same width as that of the scavenging inlet port 31*a* are formed on both sides of a lower external peripheral wall (skirt portion) 22B of the piston 20, thereby enabling these cut-out portions 22*s* to serve as the aforementioned scavenging introducing passageways 40. Therefore, in the descending stroke of the piston 20, the effective opening area of the scavenging inlet ports 31*a* is caused to gradually decrease by the movement of the upper external peripheral wall 22A (which is located higher than the cut-out portions 22*s*) of the piston 20. In other words, it is designed such that the scavenging inlet ports 31*a* can be gradually narrowed (or contracted) concomitant with the descending movement of the piston 20.

In this embodiment, a total cross-sectional area (a total of two passageways) of the scavenging introducing passageways 40 is set to about ⅓ of a total cross-sectional area (a total of four passageways) of the aforementioned scavenging passageways 31 and 32.

As shown in FIG. 5(B), on the upper peripheral wall 22A defining the top edge of each of the cut-out portions 22*s* of the piston 20, there is formed a recessed portion 23 having a central rib 23*a* and opened to face the scavenging inlet ports 31*a* and the scavenging outlet ports 31*b* and 32*b*. The provision of these recessed portions 23 is expected to be advantageous, in addition to an increased lightening of the piston which is already lightened by the formation of the cut-out portions 22*s*, in the following respects, i.e. (a) due to the air-fuel mixture K freshly introduced into the scavenging passageways 31 and 32 and passing through the recessed portions 23, it is possible to expect the effect of promoting the cooling of pin boss portion 26 as well as the gasification-promoting effect of the air-fuel mixture K; (b) due to the retention of the lubricating oil, it is possible to expect the effect of promoting the lubricity of the piston 20; (c) due to the provision of the central rib 23*a*, it is possible to expect the effect of reinforcing the piston; and (d) it is possible to expect the effect of finely adjusting and rectifying the scavenging gas flow.

According to the two-stroke internal combustion engine 1 of this embodiment which is constructed as described above, as the pressure in the crank chamber 18 is decreased in the ascending stroke of the piston 20, the air-fuel mixture K supplied from an air-fuel mixture-generating means such as carburetor is sucked into the crank chamber 18 and stored therein. When the air-fuel mixture K existing inside the combustion actuating chamber 15 disposed over the piston 20 is ignited and exploded, the piston 20 is pushed downward due to the generation of a combustion gas. During this descending stroke of the piston 20, the air-fuel mixture K existing in the crank chamber 18 and in the scavenging passages 31 and 32 are compressed by the piston 20, and at the same time, an exhaust port 34 is opened at first, and when the piston 20 is further descended, the scavenging outlet ports 31*b* and 32*b* are opened. During this scavenging period wherein the scavenging outlet ports 31*b* and 32*b* are opened, the effective opening area of the scavenging outlet ports 31*b* and 32*b* is gradually increased in conformity with the descending movement of the piston 20, and at the same time, the effective opening area of the scavenging inlet ports 31*a* is gradually decreased due to the shift of the upper external peripheral wall 22A of the piston 20. Then, the air-fuel mixture K that has been compressed in the crank chamber 18 is introduced into the scavenging inlet ports 31*a* through the scavenging introducing passageways 40 provided between the cylinder bore 10*a* and the lower external peripheral wall 22B of the piston 20 as indicated by a dotted arrow in FIG. 1. The air-fuel mixture K is then ejected from the scavenging inlet ports 31*a* into the downstream side of the scavenging passages 31 and 32 and sucked in the direction of the combustion actuating chamber 15. Thereafter, the air-fuel mixture K is blown out, as a scavenging gas flow, from the scavenging outlet ports 31*b* and 32*b* at a predetermined horizontal scavenging angle toward the inner wall of the cylinder bore 10*a* which is located opposite to the exhaust port 34. Upon being impinged against this inner wall of the cylinder bore 10*a*, the flow of air-fuel mixture K is caused to turn around, thus pushing the combustion waste gas (exhaust gas) E toward the exhaust port 34.

In this case, since the total cross-sectional area of the scavenging introducing passageways 40 is made smaller than the total cross-sectional area of the scavenging passageways 31 and 32 (preferably, about ⅓) and at the same time, the scavenging inlet ports 31*a* are gradually narrowed (or contracted) concomitant with the descending movement of the piston 20, the degree of reduction in pressure and flow rate of the scavenging gas can be minimized even in the latter stage of the descending stroke of the piston 20 (in the vicinity of bottom dead center) as compared with the conventional engine where the scavenging inlet ports which open to the crank chamber are not contracted (i.e. the cross-sectional area of the scavenging inlet ports is substantially the same as the cross-sectional area of the scavenging passageway). Because of this, it is possible to provide the scavenging gas K to be blown out of the scavenging outlet ports 31*b* and 32*b* into the combustion actuating chamber 15 with a predetermined thrusting force (pressure) and with a directionality throughout the entire period of scavenging process (see FIG. 3). Therefore, it is now possible to further promote the atomization effect of fuel during the scavenging stroke, to improve the scavenging efficiency (trapping efficiency), and to enhance the combustion efficiency. As a result, it is now possible to effectively minimize the poisonous components, in particular, the total HC, and additionally to enhance the fuel consumption.

Further, since the scavenging introducing passageways 40 are provided by simply forming cut-out portions 22*s* at the lower external peripheral wall 22B of the piston 20, it is no longer required to separately prepare parts or to greatly modify the conventional engine, thus rendering the present invention highly advantageous in terms of manufacturing cost.

Additionally, in the case of two-stroke internal combustion engine, fuel (gasoline) is usually mixed with lubricating oil before use, so that the fuel/lubricating oil mixture in the air/fuel mixture that has been introduced into the crank chamber is subjected to the effect of centrifugal separation especially on the occasion of high-speed revolution of engine, resulting in the separation of much of the fuel/lubricating oil mixture from the air component, thus allowing the fuel/lubricating oil mixture to adhere onto the inner wall of the crank chamber. In the case of the two-stroke internal combustion engine 1 according to this embodiment, since the cross-sectional area of the scavenging inlet ports 31*a* (the aforementioned scavenging introducing passageways 40) is made relatively narrow, the lubricating oil is permitted to easily separate from the fuel component prior to the introduction of the air/fuel mixture into the scavenging passageways 31 and 32, thus permitting much of the lubricating oil to leave in the crank chamber 18. Therefore, even if the supply flow rate of fuel (the fuel/lubricating oil mixture) is reduced (i.e. even if the air/fuel mixture is made more lean), it is possible to secure a sufficient quantity of lubricating oil required for lubricating the sliding components such as piston 21, connecting rod 22, crank shaft, etc., thus preventing the lubricity of these components from being deteriorated.

Further, when the engine (of a portable working machine) is suddenly changed in attitude to a great extent (for example, when the body of chain saw is suddenly inclined upward) in the idling operation thereof, the fuel/lubricating oil mixture which remains as fluid in the crank chamber is permitted to excessively flow into the combustion actuating chamber through the scavenging passageway if the scavenging inlet port is disposed on the crank chamber side, thereby possibly resulting in engine malfunction such as an engine stall. In the case of this embodiment however, the fuel/lubricating oil mixture which is left as fluid in the crank chamber is barely permitted to flow at a stroke into the scavenging passageway, thereby making it possible to suppress the generation of the malfunction of engine.

Figure 6:
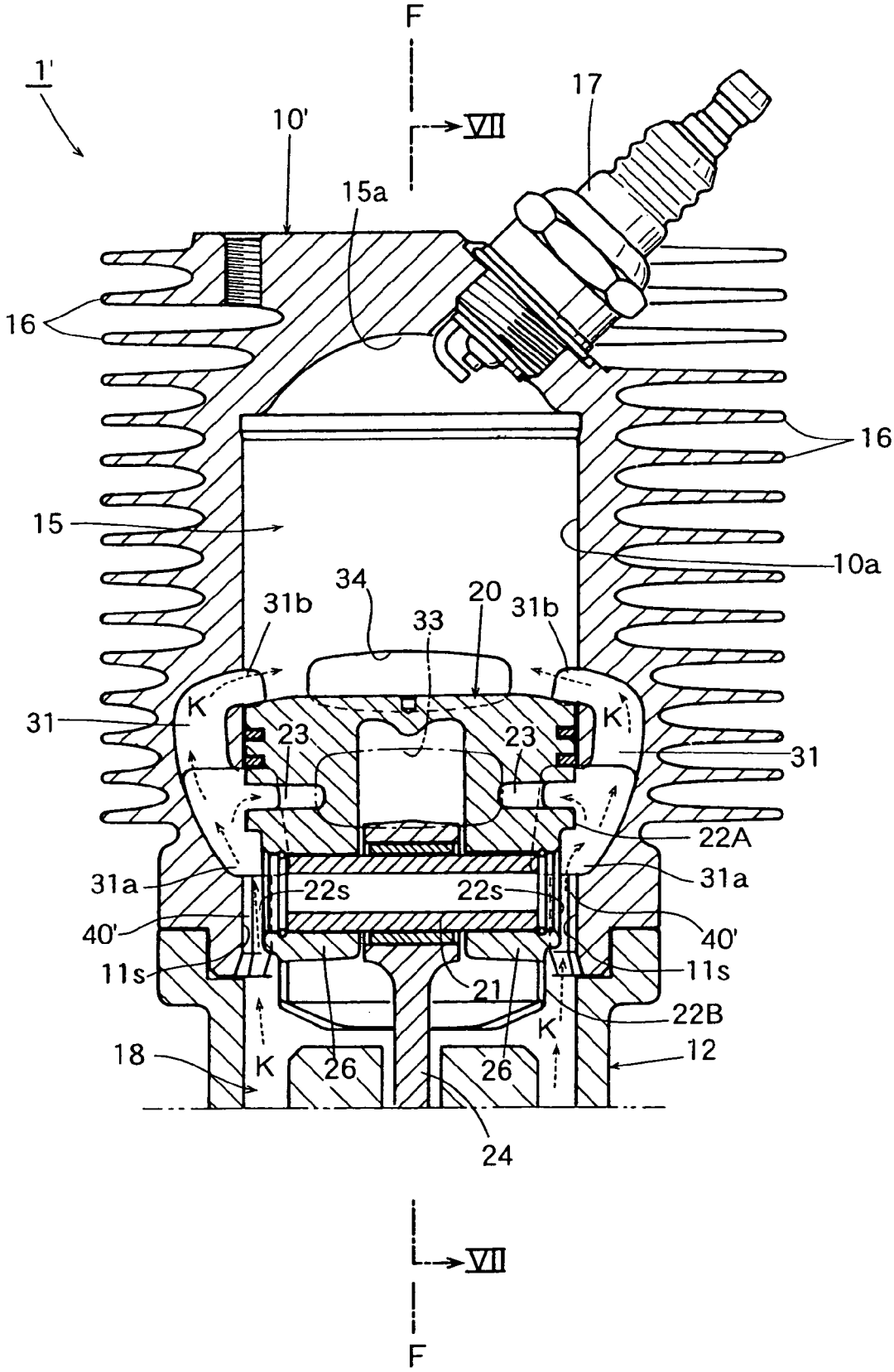
FIG. 6 is a longitudinal sectional view illustrating another embodiment of a two-stroke internal combustion engine according to the present invention.
Figure 7:
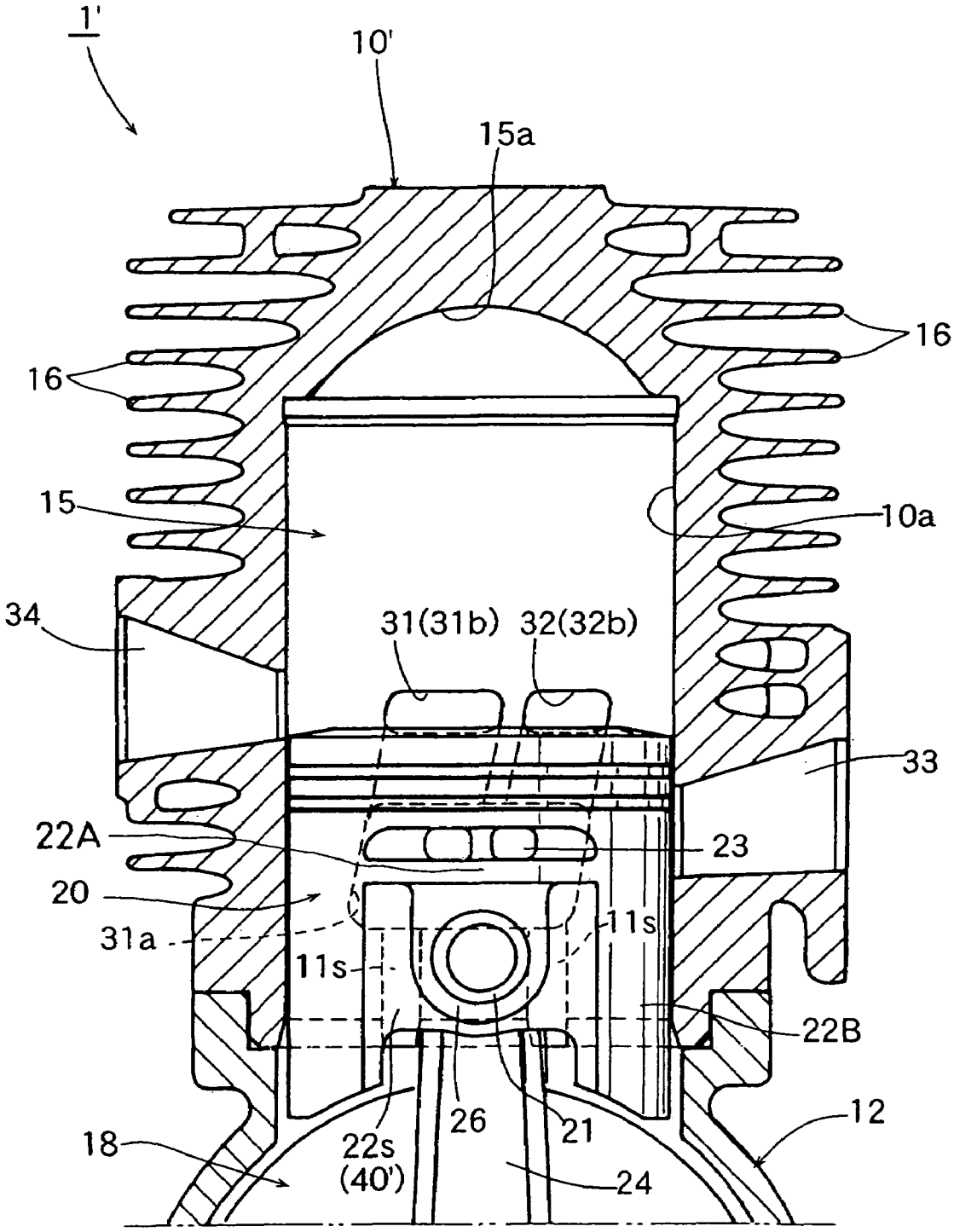
FIG. 7 is a cross-sectional view taken along the line VII—VII in FIG. 6.
Figure 8:
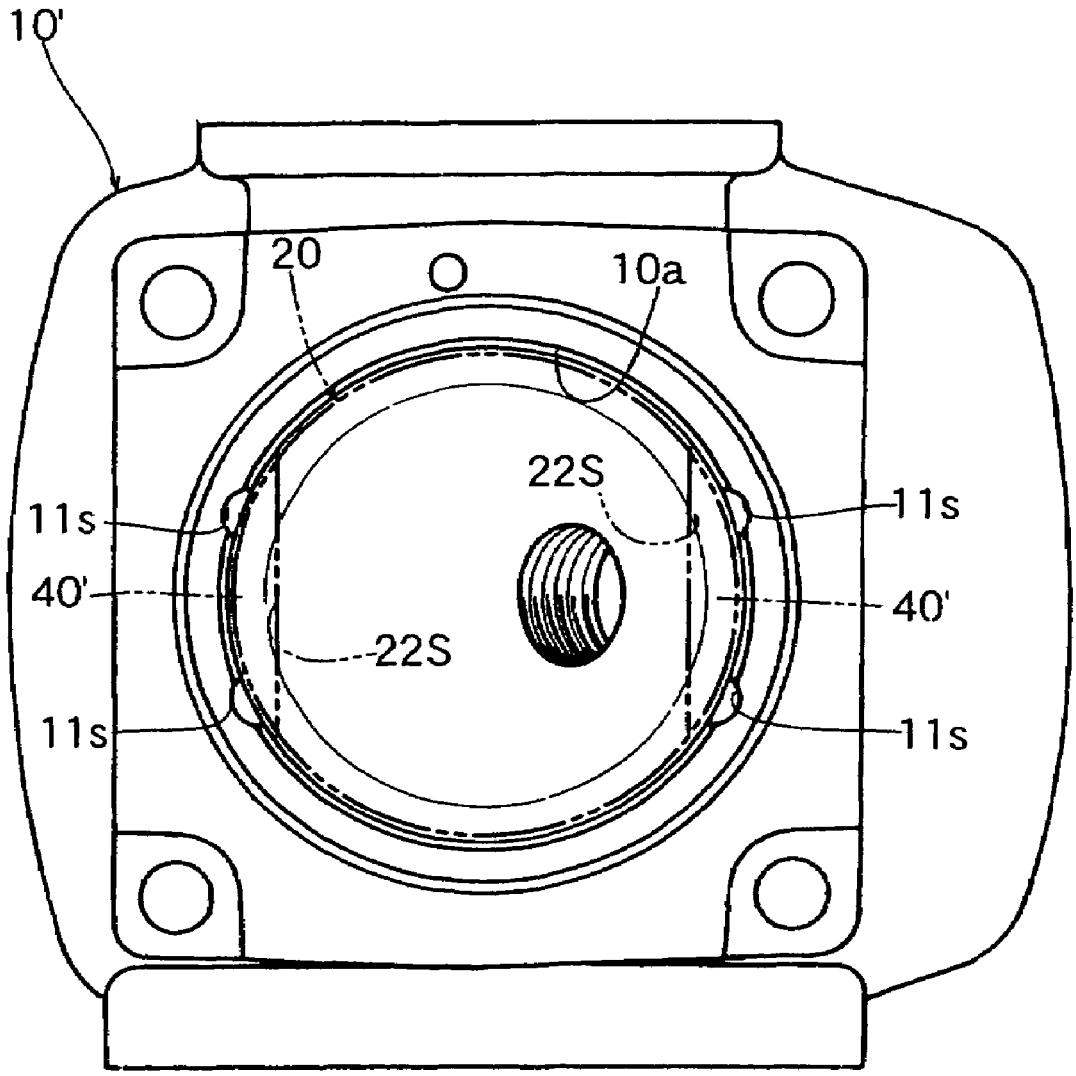
FIG. 8 shows a bottom view of the single body of cylinder of the engine shown in FIG. 6.

FIGS. 6 and 7 respectively shows a longitudinal sectional view illustrating another embodiment of a two-stroke internal combustion engine according to the present invention; and FIG. 8 shows a bottom view of the single body of the cylinder 10' of the engine I' shown in FIGS. 6 and 7. In the case of the two-stroke internal combustion engine 1' according to this embodiment, the scavenging introducing passageways 40' is constituted by cut-out portions 22*s* each formed on a lower external peripheral wall 22B of the piston 20, and by two pairs of longitudinal grooves 11*s* each having a half-moon-shaped configuration in cross-section and each pair being formed at a lower portion of the cylinder bore 10*a* so as to nearly correspond with the opposite ends, in widthwise direction, of each of the cut-out portions 22*s*. These longitudinal grooves 11*s* are configured so as to permit the crank chamber 18 to communicate with the lower edge portions of the scavenging inlet ports 31*a*.

Since these longitudinal grooves 11*s* constituting the scavenging introducing passageways 40' are additionally provided on the cylinder 10' side, it is now possible to more reliably give a desired directionality to the scavenging gas K to be blown out of the scavenging outlet ports 31*b* and 32*b* into the combustion actuating chamber 15.

Figure 9:
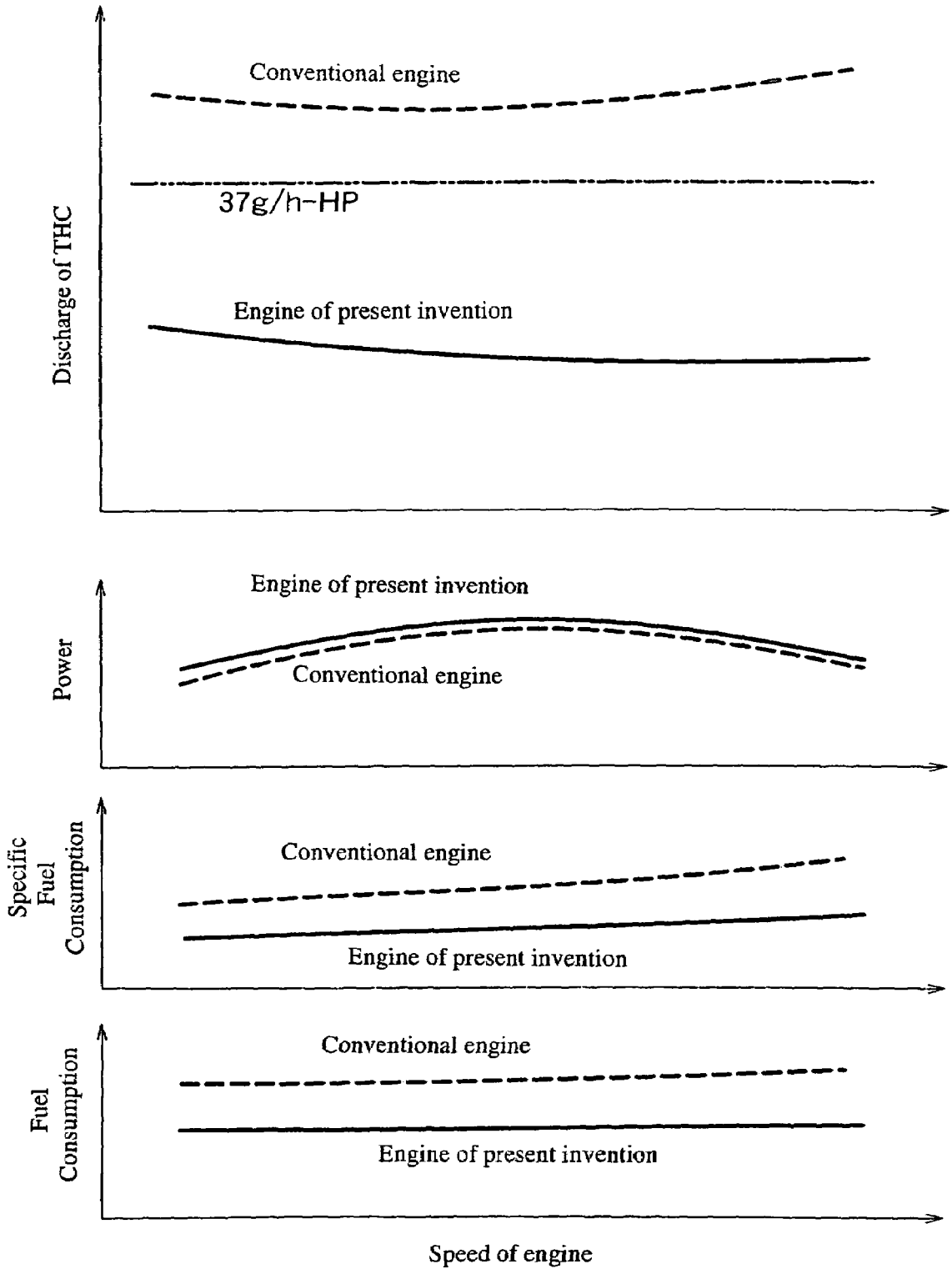
FIG. 9 is a graph showing the results of the comparative experiments performed between the engine of the present invention and the engine of the prior art.

When comparative experiments were performed using the engine 1' (the engine of the present invention) of this embodiment constructed as described above and the engine (the conventional engine) where the scavenging inlet ports opened to the crank chamber were not contracted with regard to the discharge of THC (g/h-HP), the power (HP), the specific fuel consumption (SFC) and the fuel consumption (L/h), the results shown in FIG. 9 were obtained. In this FIG. 9, the horizontal axis represents the rotational speed of engine when the engine was operated with throttle valve being fully opened. As seen from FIG. 9, the discharge of THC in the engine of the present invention was found about 25% lower than the conventional engine. More specifically, the engine of the present invention was found capable of easily satisfying Pan-American Standard (EPA PHASE II 2005; Class IV): 37 g/h-HP, which the conventional engine failed to satisfy. Further, the power of the engine of the present invention was found slightly higher than that of the conventional engine. The specific fuel consumption in the engine of the present invention was improved by about 12% as compared with the conventional engine, and the fuel consumption in the engine of the present invention was decreased by about 10% as compared with the conventional engine.

While in the foregoing one embodiment of the present invention has been explained in details for the purpose of illustration, it will be understood that the construction of the device can be variously modified without departing from the spirit and scope of the invention claimed in claims attached herewith.

For example, in the foregoing embodiments, in order to form the scavenging introducing passageways 40, the cut-out portions 22*s* were formed by cutting a lower external peripheral wall 22B of the piston 20 so as to form a parallel-chamfered configuration. However, it is a matter of course that the lower external peripheral wall 22B of the piston 20 may be cut out so as to form any optional configuration as required such as a U-shaped groove.

According to the present invention, it is to provide a two-stroke internal combustion engine which can be manufactured without necessitating the tremendous modification of the structure thereof, which can be manufactured at a low cost and which is capable of effectively suppressing the blow-by of unburnt air-fuel mixture, of minimizing as much as possible poisonous components such as HC, etc. that may be discharged into air atmosphere, and of preventing the generation of malfunction of operation that may be brought about due to excessive supply of the lubricating oil into the combustion actuating chamber.

What is claimed is:

1. A two-cycle internal combustion engine comprising: a piston, a cylinder bore, a crank chamber and at least one pair of C shaped scavenging passageways of a reverse flow system where at least one scavenging gas inlet port as well as at least one scavenging gas outlet port are both opened to the cylinder bore, wherein a scavenging gas introducing passageway for introducing an air-fuel mixture from the crank chamber into the at least one the scavenging gas inlet port is provided between the cylinder bore and the piston adapted to reciprocatively move up and down in the cylinder bore, and an effective opening area of the at least one scavenging gas inlet port is configured to be gradually decreased by the piston in the course of a descending stroke of the piston, wherein a cut-out portion for constituting the scavenging introducing passageway is formed on a lower external peripheral wall of the piston, and the effective opening area of the at least one scavenging gas inlet port is configured to be gradually decreased in the course of the descending stroke of the piston due to an upper external peripheral wall of the piston having said cut-out portion, the cut-out portion having a partially cylindrical configuration and being approximately a width of the at least one scavenging gas inlet port.

2. The two-cycle internal combustion engine according to claim 1, wherein the cylinder bore is provided with a longitudinal groove constituting part of the scavenging gas introducing passageway.

3. The two-cycle internal combustion engine according to claims 1, wherein a total cross sectional area of the scavenging introducing passageway is not more than 40% of a total cross sectional area of the scavenging passageways.

* * * * *